United States Patent [19]

Hoke et al.

[11] 4,079,644

[45] Mar. 21, 1978

[54] DOUBLE DOWNSTACKER WITH SIDE-SHIFTING CONVEYOR

[75] Inventors: Kenneth E. Hoke, Marion; Larry L. Schaper, Fairmont; George R. Cunningham, Marion, all of Ind.

[73] Assignee: Greene Line Manufacturing Corporation, Marion, Ind.

[21] Appl. No.: 774,742

[22] Filed: Mar. 7, 1977

[51] Int. Cl.[2] ..... B26D 7/06

[52] U.S. Cl. ..... 83/88; 83/89; 83/91; 83/94; 83/155; 198/862

[58] Field of Search ..... 83/88, 89, 91, 94, 155; 198/570, 586, 862; 214/6 H

[56] References Cited

U.S. PATENT DOCUMENTS

| | | | |
|---|---|---|---|
| 2,538,972 | 1/1951 | Magnani | 83/94 X |
| 3,815,482 | 6/1974 | Nelson | 198/862 X |
| 3,905,487 | 9/1975 | Hoke et al. | 214/6 H |

*Primary Examiner*—Willie G. Abercrombie

*Attorney, Agent, or Firm*—Woodard, Weikart, Emhardt & Naughton

[57] ABSTRACT

An apparatus for stacking two separate lines of cut articles exiting from a cutter equipped with two separate cutting edges, a first and second stacking platform, and an upper and lower conveyor for moving the cut shingled articles from the cutter to the platforms. A portion of the upper conveyor is also reciprocable in the horizontal plane relative to the lower conveyor to allow easy access to the lower conveyor for normal maintenance and repair and for removal of jammed or defective articles.

13 Claims, 6 Drawing Figures

DOUBLE DOWNSTACKER WITH SIDE-SHIFTING CONVEYOR

BACKGROUND OF THE INVENTION

1. Field of the Invention

This invention relates to mechanical stacking apparatus.

2. Description of the Prior Art

In the corrugated box industry, sheets of ribbed and flat paperboard material are first glued together to produce the characteristic corrugated structure. A conveyor is then commonly used to move these sheets to a platform where they are stacked for convenient shipment or in plant storage. The industry uses what is commonly called a double downstacker, which consists of two stacking platforms and two conveyors stacked one above the other. The advantage of the double downstacker is that two lines of articles or sheets may be handled at the same time with the need for little additional space.

A major problem concerning the use of these double downstackers which has plagued the industry since their inception is one of jamming. If too much or too little glue is initially used to form the corrugated paperboard material, the board will often separate and curl just as a normal piece of paper. If this happens on the lower conveyor, the curled board invariably catches in the conveyor apparatus thereby jamming the double conveyor system. The cutter and conveyors must then be shut down and the jammed boards removed. This process is difficult because the two conveyors are generally spaced close together vertically thereby providing little room to work. Additionally, each shutdown needed to unjam the conveyors constitutes a significant waste of time, energy and money.

These shutdown periods and the amount of time, energy and money they require are substantially lessened by the present invention. By providing means for moving the upper conveyor relative to the lower conveyor, the present invention significantly reduces the time and energy needed to remove the defective or jammed boards thereby also reducing the accompanying loss of production and money.

SUMMARY OF THE INVENTION

One embodiment of the present invention includes a double downstacker apparatus comprising an input means providing two separate lines of articles, a first and a second stacking platform, and an upper and lower conveyor means. Also provided is a means for moving a portion of the upper conveyor means laterally relative to the lower conveyor means to allow easy access to the lower conveyor means for normal maintenance and repair and for removing defective or jammed articles. In this way, the movable upper conveyor can be aligned with a portion of the full width of corrugated material which is cut and then moved on the upper and lower conveyors to the stacking platforms. By so aligning the movable upper conveyor, the lower conveyor is thereby partially exposed thus allowing easy access to the lower conveyor means.

More specifically, a portion of the upper conveyor is bearingly mounted on a pair of rails and is reciprocally drivable in the horizontal plane along the rails by a gear and motor arrangement.

Another embodiment of the present invention includes a method of unjamming the lower conveyor of a double downstacker apparatus comprising laterally moving a portion of the upper conveyor in the horizontal plane relative to the lower conveyor to allow access to the lower conveyor surface and removing the jammed article from the lower conveyor. Also provided is the step of aligning the movable upper conveyor with a slitter knife and a portion of the full width of corrugated material to be moved on the upper and lower conveyors to the stacking platforms.

It is an object of the present invention to provide a double downstacker apparatus that will allow easy access to the lower conveyor for general maintenance and repair and for removing jammed or defective articles.

It is a further object of the present invention to provide a double downstacker apparatus with a movable conveyor that will substantially lessen the loss of time, energy and money resulting from jammed or defective articles.

Related objects and advantages of the present invention will be apparent from the following description.

DESCRIPTION OF THE PREFERRED EMBODIMENTS

Figure 1:
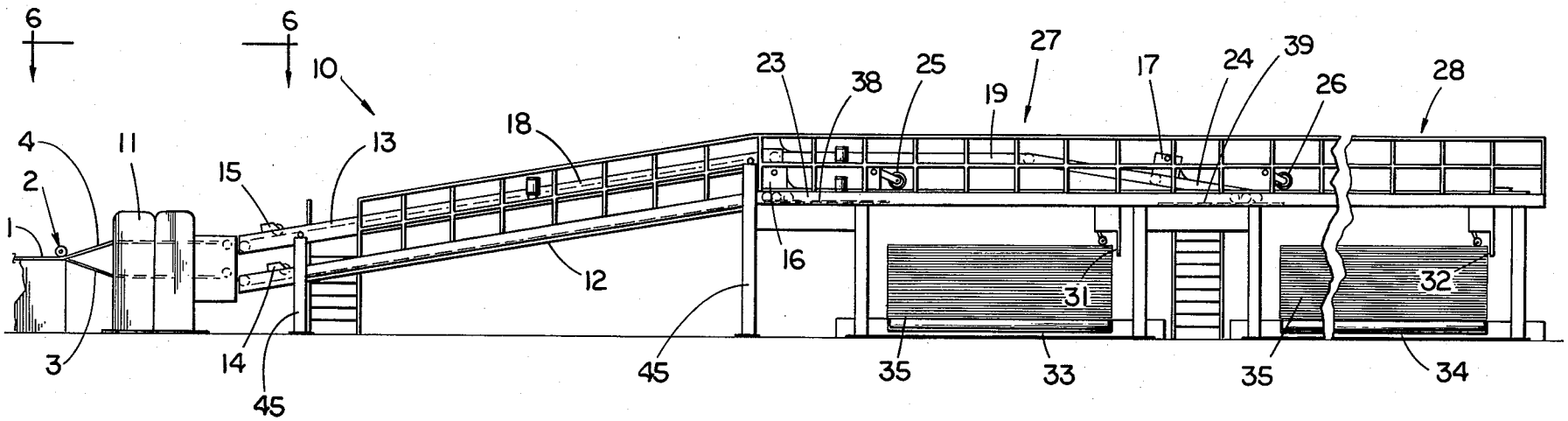
FIG. 1 is a partial side view of the double downstacker apparatus with side-shifting conveyor of the preferred embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is illustrated therein the double downstacker apparatus with side-shifting conveyor 10 which constitutes the preferred embodiment of the present invention. At one end of the downstacker is a cutter 11. Cutter 11 is conventional and commercially available, an example being a Langston Model 182 Cut-off Knife. The cutter is equiped with two cut-off knives and is designed to handle and cut off two separate continuous sheets of corrugated paperboard material. Each cut-off knife can also be automatically or mannually adjusted to separately size the two lines of cut articles according to length during the operation of the downstacker.

Initially, a single continuous sheet of corrugated paperboard material 1 is supplied generally from a large roll of such material (not shown) to a conventional slitter knife 2 which cuts the single sheet into two separate continuous sheets of material 3 and 4 which are then fed into cutter 11. A common type of such knife usable with the above-described cutter 11 is a rotary slitter knife. As with the cut-off knives, slitter knife 2 can be automatically or manually adjusted to vary the relative widths of sheets 3 and 4, single sheet 1 being generally about 96 inches in width.

The separate lines of properly-sized articles exiting cutter 11 are discharged onto conveyors 12 and 13, respectively. Snubber wheel assemblies 14 and 15, as further described below, are positioned near cutter 11 on conveyors 12 and 13, respectively, and are operable to shingle or overlap the separate lines of articles as they are discharged from the cutter. This shingled or overlapped effect is accomplished under normal conditions by operating cutter 11 at a higher speed than conveyors 12 and 13. The articles are thrown out onto the conveyors and against the snubber wheel assemblies which in turn press the articles to the conveyor surfaces and thus produce the shingled effect.

Under normal circumstances, conventional pivot gates 16 and 17 are in the retracted position and do not affect the flow of cut shingled articles along conveyors 12 and 13, respectively. As shown in FIG. 1, conveyor 13 consists of two separate conveyor sections 18 and 19 which convey the cut shingled articles from cutter 11 to the stacking platform.

Conveyor speed-up sections 23 and 24 are positioned between pivot gates 16 and 17 and stacking areas 27 and 28, respectively. While the pivot gates are retracted, the conveyor speed-up sections are driven at the same speed as conveyors 12 and 13 and articles are conveyed directly past rollers 25 and 26 to stacking areas 27 and 28. However, when a stack is completed, the pivot gate is lowered thereby blocking the flow of shingled articles and causing a gap to form. The speed-up section is then actuated thereby increasing the speed and rapidly delivering the last few articles to the stacking area.

As the articles are discharged into stacking areas 27 and 28, they are continuously pressed against adjustable backstops 31 and 32. The stacked articles 35 are then supported by elevators 33 and 34 which operate to gradually lower as the number of stacked articles thereon increases. When the elevators have reached their maximum stacking height and the gaps have been created, the pivot gates are again retracted and the speed-up sections slowed. Motordriven hoppers 38 and 39 then extend into stacking areas 27 and 28, respectively, and temporarily receive the discharged articles thereby allowing the elevators to be emptied.

A complete disclosure of the apparatus and operation of the pivot gates, rollers and stacking areas used in the preferred embodiment of the present invention is found in U.S. Pat. No. 3,905,487 issued to Hoke et al. on Sept. 16, 1975; and the same is herein incorporated by reference.

A practical alternative to the elevators disclosed in the Hoke et al. reference are hydraulic scissor-lifting assemblies which are vertically movable to support the increasing stacks of articles by operation of their hydraulic scissor-like structures.

Figure 2:
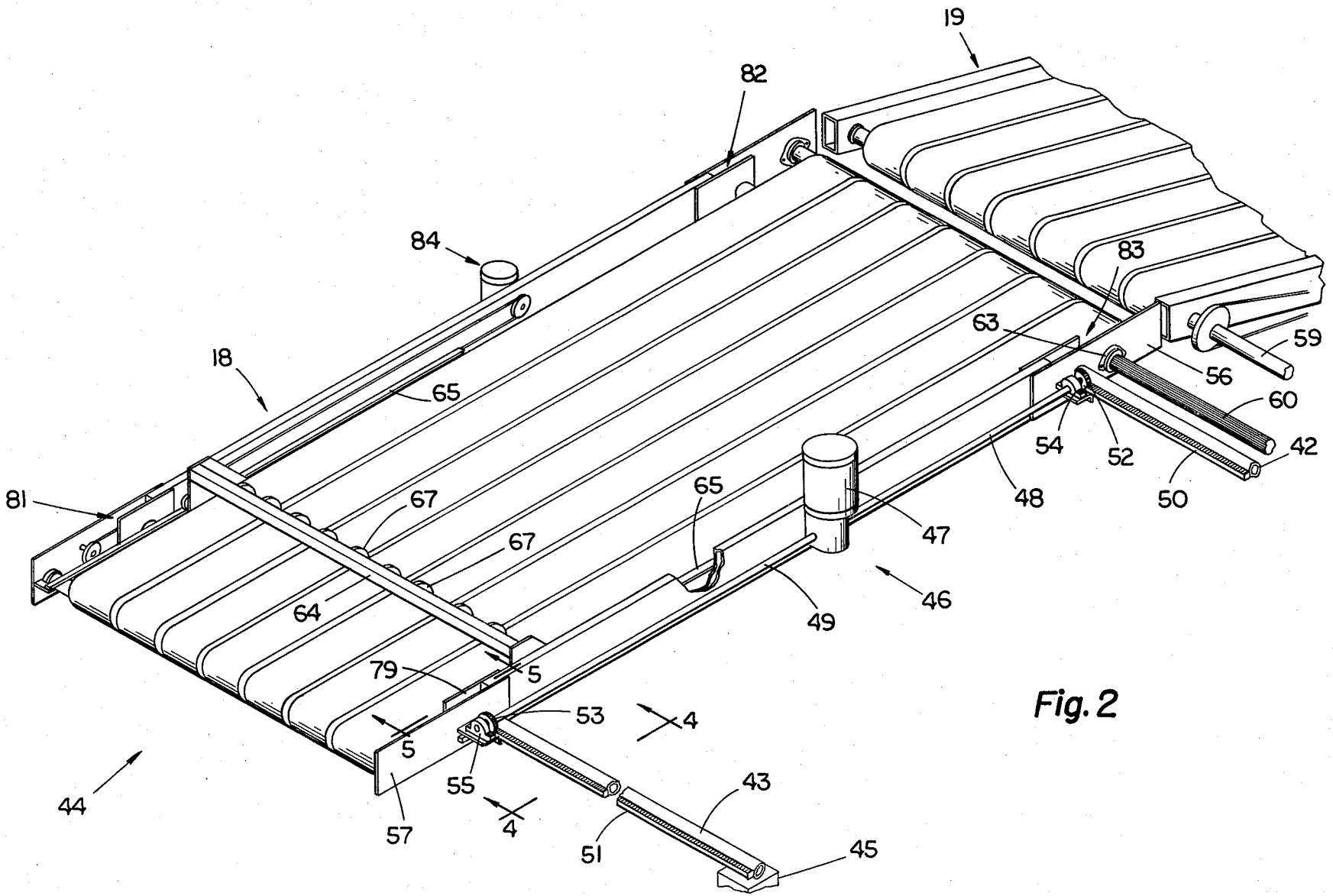
FIG. 2 is a partial overhead view of only the side-shifting upper conveyor shown in FIG. 1 in the unshifted position with a portion cut away.
Figure 3:
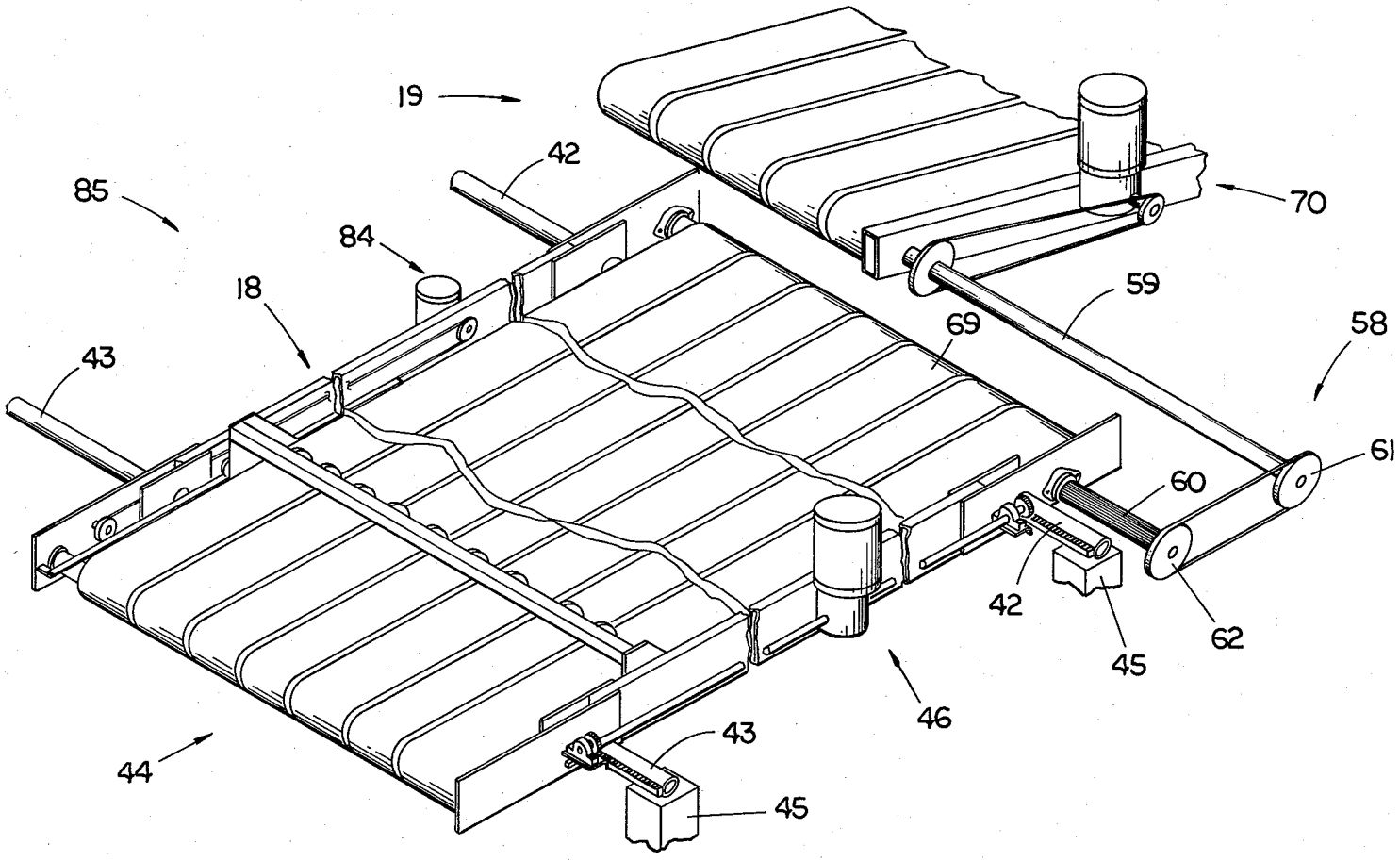
FIG. 3 is a partial overhead view of the upper conveyor in FIG. 2 in the shifted position.

Referring to FIGS. 2 and 3, the side-shifting upper conveyor section 18 of the preferred embodiment is illustrated in its extreme positions, lower conveyor 12 having been removed for purposes of clarity. Two rails or tubes 42 and 43 extend perpendicularly across the direction of article flow 44 and are fixedly mounted to supporting posts 45. Two gear racks 50 and 51 are also mounted to supporting posts 45 and rigidly extend parallel to and adjacent the tubes. Conveyor section 18 of conveyor 13 is bearingly mounted on the tubes, as further illustrated in FIG. 5 and described below, and is slidable thereon.

An electric motor and gear assembly 46, including an electric motor 47, drive shafts 48 and 49, and spur gears 52 and 53, is attached to the side of conveyor section 18 and is operable to reciprocate section 18 along the tube and gear rack assembly. This is accomplished by fixedly mounting the spur gears to the distal ends of the drive shafts and rotatably mounting these drive shafts in two plate housings 54 and 55 which are in turn mounted to plates 56 and 57, respectively. The outer ridged surfaces of the spur gears contact the geared surfaces of the two racks so that when motor assembly 46 is operated, the spur gears are driven along the racks thus causing conveyor section 18 to move along tubes 42 and 43.

Joining conveyor sections 18 and 19 is a belt and sprocket assembly 58 including a coupled shaft 59, a spline shaft 60 and two belt-driven sprockets 61 and 62. Coupled shaft 59 is connected to conveyor section 19 and is rotatable by a conventional motor, chain and sprocket assembly 70 which directly controls the movement of conveyor section 19. This motion is in turn imparted by coupled shaft 59 through sprockets 61 and 62 to spline shaft 60. Spline shaft 60 has a geared outer surface and is slidably and rotatably received in housing 63 mounted to plate 56. The rotation of spline shaft 60 in turn rotates a sprocket and belt assembly (not shown) which drives the conveyor belts 69. Conveyor section 18 is thereby driven at the same speed as conveyor section 19 to allow continuous movement of shingled articles along conveyor 13. The fact that spline shaft 60 is slidably received in housing 63 is also important because it allows movement of conveyor section 18 along tubes 42 and 43 without the need for disconnecting its main drive assembly.

A snubber bar 64 is slidably mounted on two ledges 65 above conveyor section 18. A portion of wall 71 has been fragmented to reveal the second ledge 65. A plurality of idler wheels 67 are connected to this bar and suspended slightly above the conveyor surface. As the articles are discharged from the cutter onto the conveyor surface, they are traveling at a higher rate of speed than the conveyor, as previously discussed. The snubber bar and idler wheels shingle or overlap the rapidly-moving articles by catching them and pressing them to the surface of the conveyor. A conventional motor and chain assembly 84 is also provided for driving the snubber bar along ledges 65 to handle different sizes of cut articles. A similar snubber bar is positioned above the surface of conveyor 12.

Figure 4:
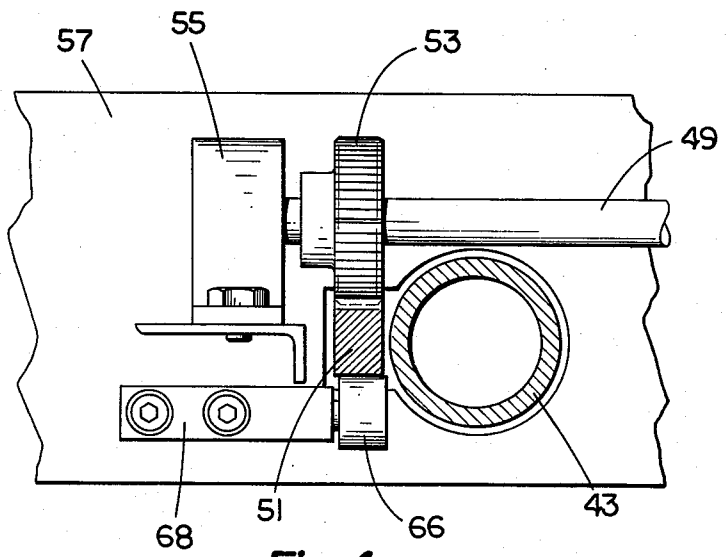
FIG. 4 is an enlarged fragmentary cross-sectional view of the tube, rack and spur gear assembly of the preferred embodiment taken along line 4—4 in FIG. 2 and viewed in the direction of the arrows.

To make sure that spur gears 52 and 53 do not disengage gear racks 50 and 51 while conveyor section 18 is reciprocated between its positions in FIGS. 2 and 3, a roller bearing 66 is mounted to conveyor section 18 beneath each rack and contacts the rack opposite and slightly behind the spur gear. As better shown in FIG. 4, roller bearing 66 is received in a bearing block 68 which is bolted to plate 57. The bearing presses the geared surface of rack 51 against spur gear 53 thereby preventing the possibility of any disengagement. A similar roller bearing maintains the contact between rack 50 and spur gear 52.

Figure 5:
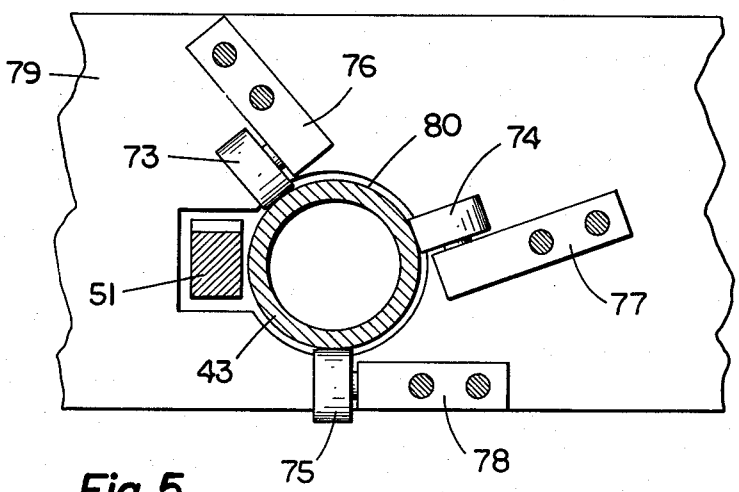
FIG. 5 is an enlarged fragmentary cross-sectional view of the bearing contact between the shifting conveyor and the tube taken along line 5—5 in FIG. 2 and viewed in the direction of the arrows.

FIG. 5 illustrates the bearing contact between conveyor section 18 and tubes 42 and 43. Three roller bearings 73, 74 and 75 are received in bearing blocks 76, 77 and 78, respectively, and are bolted between plates 57 and 79 with their roller surfaces contacting the outer tube surface 80, as shown in FIG. 5. Similar bearing arrangements are located at points 81, 82 and 83 as shown in FIG. 2. Conveyor section 18 is thereby readily slidable along tubes 42 and 43.

The method of operating the double downstacker apparatus with side-shifting conveyor of the preferred embodiment is as follows: First, the desired relative widths of the two separate lines of articles is determined and the slitter knife 2 is positioned accordingly. The desired lengths of the separate lines of articles are also determined at this time and the proper adjustments are made to the two separate cut-off knives in cutter 11.

Second, electric motor 47 is activated and the side-shifting conveyor section 18 is driven along tubes 42 and 43 the distance necessary to properly align the conveyor section with slitter knife 2 and the particular width of articles to be conveyed on conveyor 13. Properly aligning conveyor section 18 also operates to expose a portion of lower conveyor 12 which also corresponds to the particular width of cut shingled articles to be conveyed on the lower conveyor.

Figure 6:
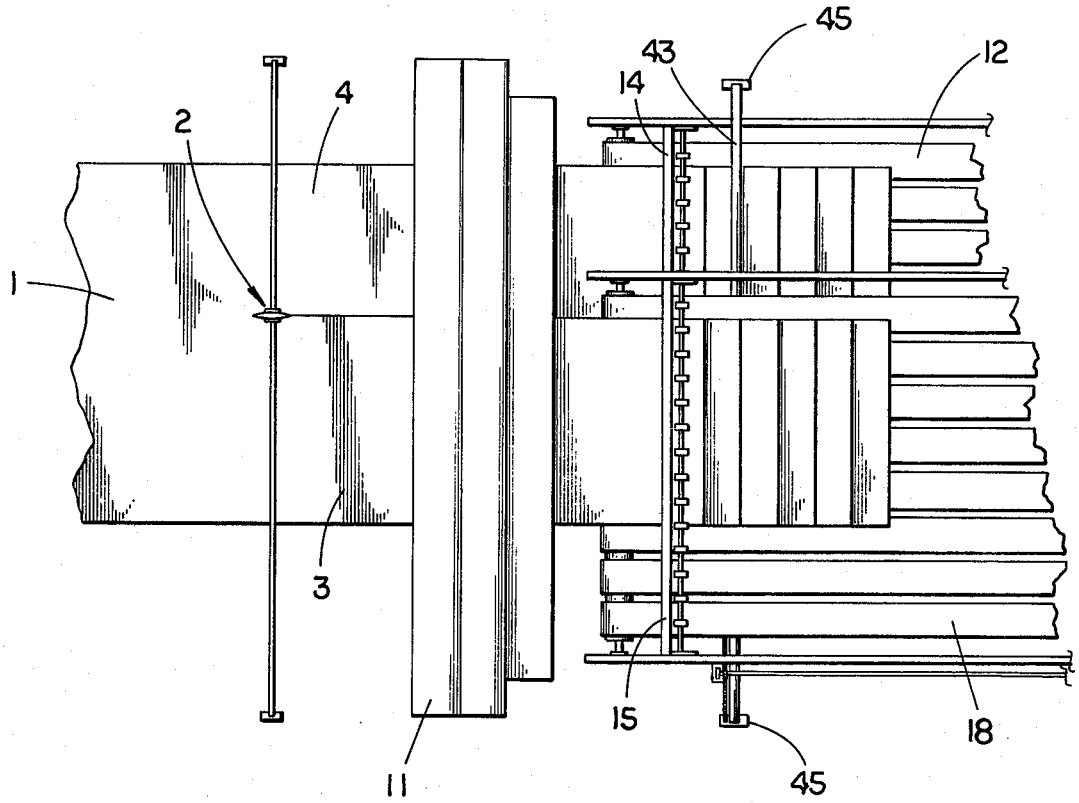
FIG. 6 is a top view of the double downstacker apparatus in FIG. 1 taken along line 6—6.

Once proper alignment is obtained, the double downstacker 10 of the preferred embodiment is activated and cut shingled articles are conveyed along conveyors 12 and 13 to stacking areas 27 and 28, respectively, as partially shown in FIG. 6. The normal operational speed of the double downstacker of the preferred embodiment is sufficiently slow that the operator can usually remove a jammed or defective article from either the lower or upper conveyor without interrupting the normal flow. The possibility of such in-line removal is, of course, greatly increased in the present invention because it allows easy access to the lower conveyor surface.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A double downstacker apparatus with a movable conveyor comprising:

(a) input means for providing two separate lines of articles;

(b) a first stacking platform for stacking the first line of articles;

(c) a second stacking platform for stacking the second line of articles;

(d) a first conveyor means for moving the first line of articles from said input means to said first stacking platform;

(e) a second conveyor means mounted above said first conveyor means for moving the second line of articles from said input means to said second stacking platform;

(f) and means engaged with said second conveyor means for laterally moving a portion of said second conveyor means relative to said first conveyor means to allow removal of defective articles from said first conveyor means.

2. The apparatus of claim 1 in which said input means comprises:

(a) a single continuous supply of corrugated material;

(b) and cutting means including a slitter knife for cutting said single supply into two separate continuous lines of corrugated material, the slitter knife being adjustable to vary the respective widths of the separate lines, said means for laterally moving being operable to align the movable portion of said second conveyor means with the slitter knife and one of the two continuous lines of corrugated material.

3. The apparatus of claim 2 in which said cutting means further comprises two separate cutting edges for cutting the two separate continuous lines into two separate lines of cut articles, the cutting edges being independently adjustable to separately size the two lines of cut articles according to length.

4. The apparatus of claim 1 in which a portion of said second conveyor means is slidably mounted above said first conveyor means and is reciprocally movable in the horizontal plane.

5. The apparatus of claim 4 additionally comprising driving means for reciprocating a portion of said second conveyor means in the horizontal plane.

6. The apparatus of claim 5 in which said driving means comprises:

(a) a rail, said movable portion of said second conveyor means being bearingly mounted on said rail and slidable thereon;

(b) and a motor operable to drive said movable portion of said second conveyor means along said rail.

7. The apparatus of claim 6 additionally comprising means including a snubber bar and idler wheels mounted on said first and second conveyor means for shingling or overlapping the separate lines of articles as the articles are conveyed to said first and second stacking platforms.

8. The apparatus of claim 7 additionally comprising connecting means including a spline shaft for connecting the movable and nonmovable portions of said second conveyor means.

9. The apparatus of claim 8 in which said driving means further comprises:

(a) a geared rack mounted parallel to and adjacent said rail;

(b) a spur gear mounted to said second conveyor means and contacting said rack, said spur gear being reciprocally drivable along said rack by said motor;

(c) and a roller bearing mounted to said second conveyor means and contacting said rack opposite said spur gear for preventing said spur gear from disengaging said rack while said spur gear is reciprocally driven along said rack by said motor.

10. The apparatus of claim 2 additionally comprising means including a structure for vertically moving said first and second stacking platforms, said platforms being movable vertically downward a distance equal to the height of the stacked articles.

11. The apparatus of claim 8 additionally comprising driving means including a motor for directly driving the nonmovable portion of said second conveyor means to convey articles to said second stacking platform, the movable portion of said second conveyor means being indirectly driven by said driving means acting through said connecting means.

12. A method for unjamming the lower conveyor of a double downstacker apparatus comprising:

(a) laterally moving a portion of the upper conveyor of a double downstacker apparatus in the horizontal plane relative to the lower conveyor to allow access to the lower conveyor surface;

(b) and removing the jammed article from the lower conveyor.

13. The method of claim 12 in which said moving further comprises aligning the movable portion of the upper conveyor with a slitter knife and a portion of the full width of corrugated material to be moved on the upper and lower conveyors to the stacking platforms.

* * * * *